US005088565A

United States Patent [19]

Evarts

[11] Patent Number: 5,088,565

[45] Date of Patent: Feb. 18, 1992

[54] VIBRATORY PILE DRIVER

[75] Inventor: Kingsley S. Evarts, Cheswick, Pa.

[73] Assignee: J & M Hydraulic Systems, Inc., Pittsburgh, Pa.

[21] Appl. No.: 498,098

[22] Filed: Mar. 23, 1990

[51] Int. Cl.[5] ..... E02D 7/18

[52] U.S. Cl. ..... 173/49; 74/61

[58] Field of Search ..... 173/49; 175/55, 56; 74/61

[56] References Cited

U.S. PATENT DOCUMENTS

| | | | |
|---|---|---|---|
| 2,436,251 | 2/1948 | Dobie et al. | 219/15 |
| 3,004,389 | 10/1961 | Muller | 60/53 |
| 3,278,235 | 10/1966 | Bergstrom | 299/37 |
| 3,280,924 | 10/1966 | Pavlovich | 175/55 |
| 3,287,983 | 11/1966 | Austin et al. | 74/61 |
| 3,396,805 | 8/1968 | Muller | 173/49 |
| 3,528,302 | 9/1970 | Kinnan | 74/87 |
| 3,828,864 | 8/1974 | Haverkamp et al. | 173/49 |
| 4,113,034 | 9/1978 | Carlson | 173/49 |
| 4,616,716 | 10/1986 | Bouplon | 173/49 |
| 4,625,811 | 12/1986 | Tuenkers | 173/49 |
| 4,819,740 | 4/1989 | Warrington | 173/40 |

OTHER PUBLICATIONS

Brochure entitled "Hydraulic Vibratory Driver/Extractors" of International Construction Equipment, Inc., Ref. V7-0689-51.

One-page Sheet entitled "Motors, hydraulic", Ref. A/122.

*Primary Examiner*—Mark Rosenbaum
*Assistant Examiner*—Scott A. Smith
*Attorney, Agent, or Firm*—Webb, Burden, Ziesenheim & Webb

[57] ABSTRACT

A vibratory pile driver having means for clamping onto a pile or similar structure to be driven or extracted substantially linearly, e.g. vertically, includes a hydraulic gear motor having two oppositely rotatable shafts and a pair of semicircular weights aligned in the same vertical plane. Each weight is rotatably secured to a shaft parallel to the motor shafts. Means, in the form of drive and driven pulleys, sprockets or the like connected by toothed timing belts, chains or the like, respectively, are provided for driving the weights from the motor shafts. Since the gears of the hydraulic gear motor operate in synchronization, the weights are driven synchronously to provide substantially linear, e.g. vertical, forces. Such an arrangement combines the synchronizing gears and the power source and makes it possible to eliminate relatively large gears, to use larger diameter weights and to achieve, under certain designs, a smaller overall machine width adjacent the pile to be driven.

10 Claims, 6 Drawing Sheets

VIBRATORY PILE DRIVER

BACKGROUND OF THE INVENTION

1. Field of the Invention

This invention relates to a vibratory pile driver and particularly to a pile driver including at least one hydraulic gear motor, counter-rotating, semicircular weights, and means for driving the weights for transmitting vibratory forces to a pile or similar structure in a substantially linear direction.

2. Brief Description of the Prior Art

Conventional vibratory pile drivers include electric or hydraulic motor driven, counter-rotating, semicircular weights which are geared together to provide force components unidirectionally, that is only in a linear direction. Representative pile drivers are manufactured and/or sold by a number of United States and non-U.S. companies, including the assignee of the present invention.

Such pile drivers have capacities ranging from 30-200 tons centrifugal force and operate on the principle of using rotating eccentrics, usually semicircular weights, to cause vibration. The centrifugal force of the weights oppose each other, thus cancelling out any horizontal vibration component, and adding vertically resulting in only substantially linear vibration. In substantially all cases, the motor, which in the case of a hydraulic motor, is driven from a remote location, drives a shaft with the weights geared together. It is apparent that as the size of the gears increases, the pitch line velocity becomes so great that it is not practical to use gears.

Hence, belts or chains have been used in some pile drivers to connect a motor to one or more shafts upon which the weights are mounted, as shown for example in U.S. Pat. Nos. 3,280,924; 3,396,805; and 3,828,864.

However, in none of the foregoing patents, nor in any prior art of which I am aware, has a hydraulic gear motor been provided with two shafts driven counter-rotationally and been used to drive the weights in a vibratory pile driver in opposite directions, while simultaneously synchronizing the weight rotation, whether or not belts or chains have been provided. Moreover, none of the art discloses or suggests that additional conventional single-shaft hydraulic motors can be used to supplement the power transmitted to the weights from an electric or hydraulic motor.

In order to provide maximum vibratory force in a pile driver, one object of the present invention is to eliminate relatively large gears. Another object is to reduce the number of gears and shafts required to transmit maximum vibratory forces to piles or other structures to be driven or extracted. A further object of the invention is to maintain synchronization of the weights in order to concentrate forces in the vertical direction only. A further object of the invention is to permit the use of larger diameter weights without the use of large diameter gears and high pitch line velocities. A still further object is to limit the width of the driver so that it can be used to drive piles, e.g. sheets of about 14"-18" wide, between adjacent piles.

SUMMARY OF THE INVENTION

A vibratory pile driver having means for clamping onto a pile or similar structure to be driven or extracted substantially linearly, for example vertically, includes a hydraulic gear motor having two oppositely rotatable shafts and a pair of semicircular weights aligned in the same vertical plane. Each weight is rotatably secured to a shaft parallel to the motor shafts. Means, in the form of drive and driven pulleys, sprockets or the like connected by toothed timing belts, chains or the like, respectively, are provided for driving the weights from the motor shafts. Since the gears of the hydraulic gear motor operate in synchronization, the weights are driven synchronously to provide substantially linear, e.g. vertical, forces. Such an arrangement combines the synchronizing gears and the power source and makes it possible to eliminate relatively large gears, to use larger diameter weights and to achieve, under certain designs, a smaller overall machine width adjacent the pile to be driven.

The vibratory pile driver according to the invention has no high speed gears which are likely to fail at high rpm. One design of the pile driver weighs about 1 ton without the clamping means, has a weight moment of 500 inch pounds and a rotation speed of 2200 RPM@90 GPM.

In a second embodiment of the invention, a vibratory pile driver having increased power is provided. By engaging additional separate hydraulic motors directly on the shafts upon which the weights are mounted, increased horsepower can be achieved. It is estimated that up to about 650 horsepower is possible.

The details of the presently preferred embodiments of the invention will be understood from a reading of the specification taken in conjunction with the accompanying drawings.

DESCRIPTION OF PRESENTLY PREFERRED EMBODIMENTS OF THE INVENTION

Figure 1:
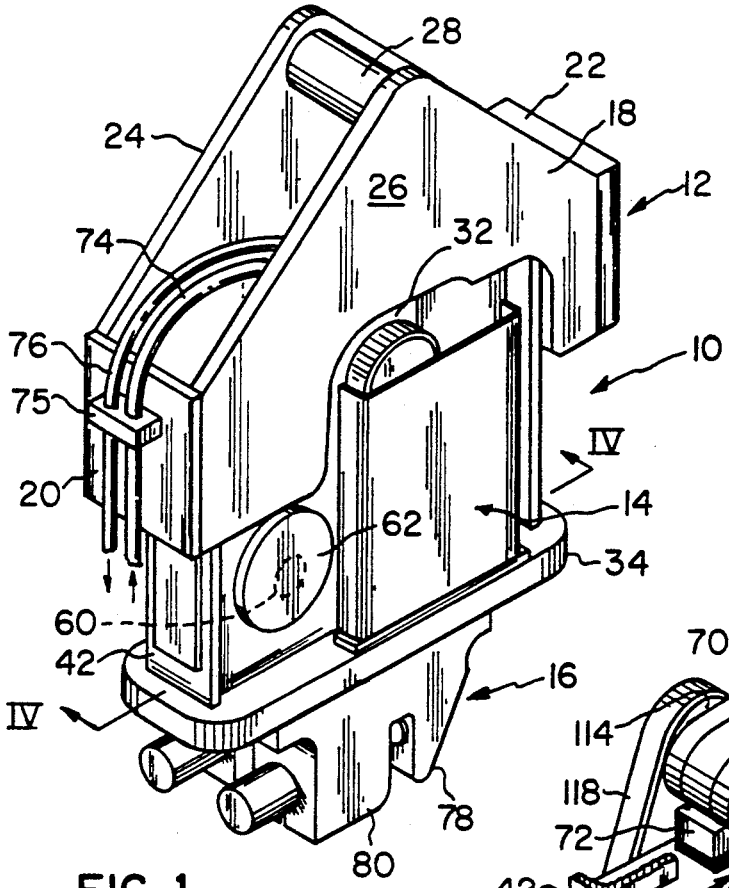
FIG. 1 is a perspective view of a vibratory pile driver in accordance with a first embodiment of the invention.
Figure 2:
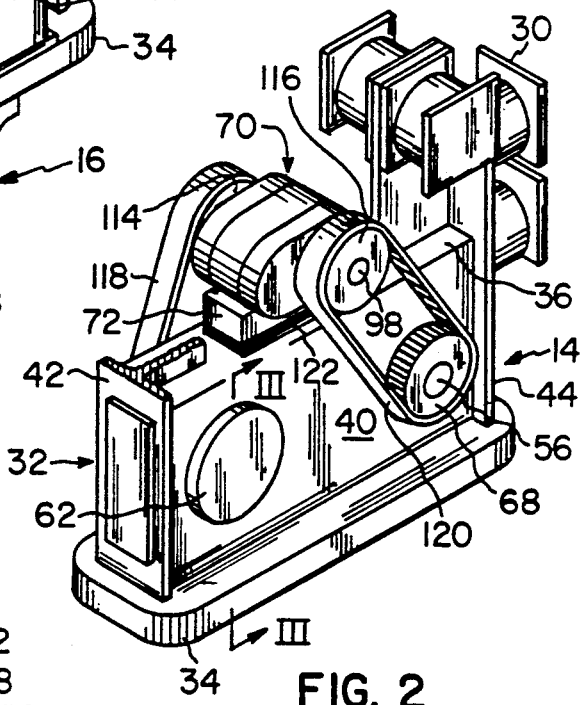
FIG. 2 is a perspective view of the vibratory pile driver of FIG. 1 with the suppressor housing, belt guards and clamping means removed.

Referring to the drawings and particularly to FIGS. 1–9, according to a first embodiment of the invention a vibratory pile driver 10 comprises a suppressor section 12, a transmission section 14 and a clamping section 16. The suppressor section 12 includes a housing 18 having front wall 20, rear wall 22 and side walls 24, 26. A lifting bale 28, which is adapted to be connected to a cable of a typical crane (not shown), extends between and is secured to the walls 24, 26 of the housing 18. Elastomers 30, such as those produced by Lord Corporation, connect suppressor section 12 to transmission section 14 and are included for damping, as shown in FIG. 2.

Figure 3:
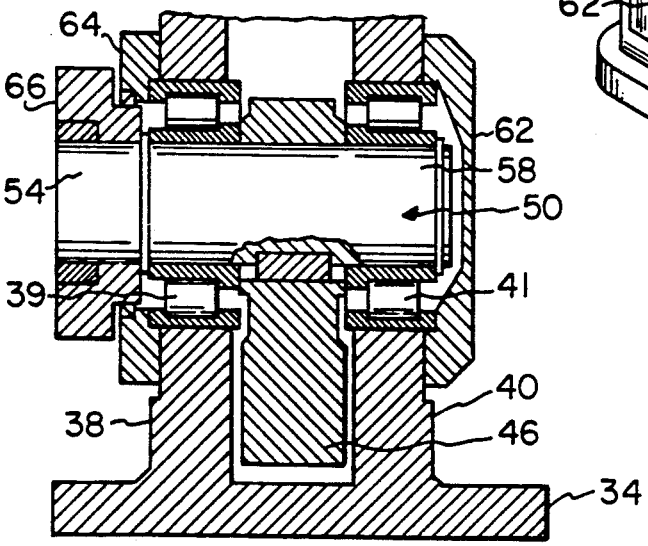
FIG. 3 is a sectional view taken along lines III—III of FIG. 2.
Figure 4:
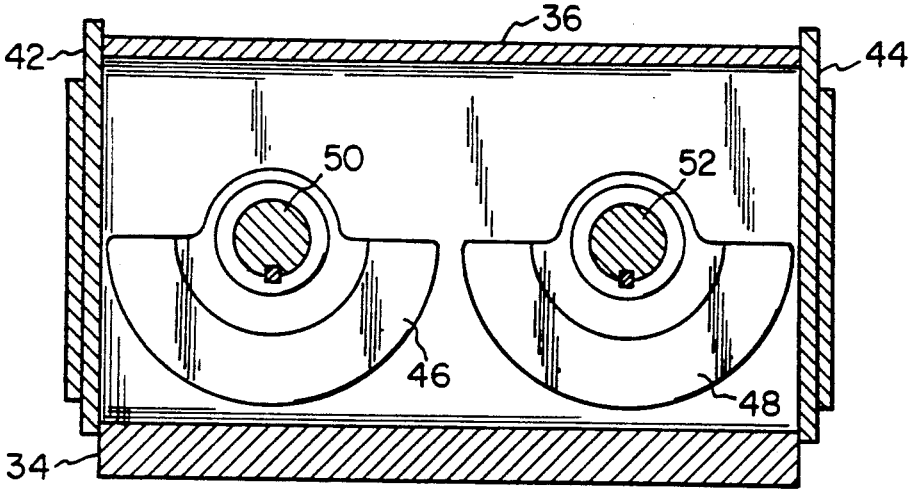
FIG. 4 is a sectional view taken along lines IV—IV of FIG. 1.
Figure 6:
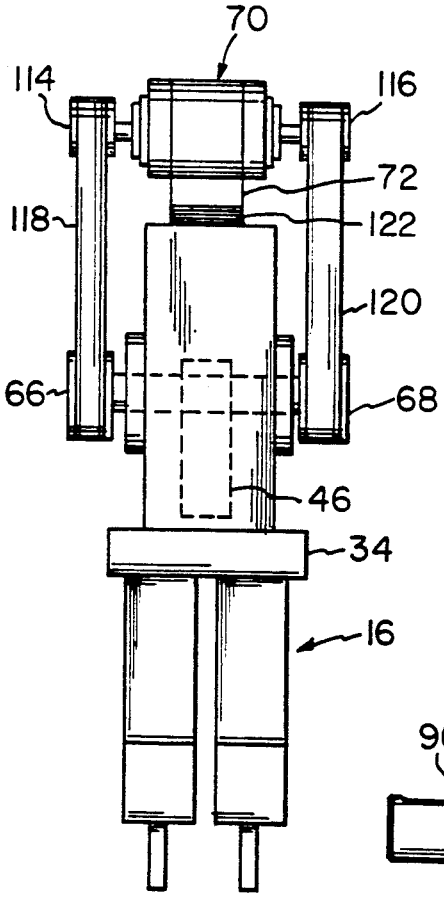
FIG. 6 is an enlarged elevational view of one end of the vibratory pile driver of FIG. 1.

The transmission section includes, as particularly shown in FIGS. 2–4, a transmission case 32 having a base 34, a top wall 36, side walls 38 and 40 and end walls 42 and 44. A pair of semicircular weights 46 and 48 are located within the case 32. The weights lie in a vertical plane in the case. Each weight 46 and 48 is rotatably keyed to a shaft 50 and 52, respectively. The shafts are supported in the side walls 38 and 40 by bearings 39 and 41. Such bearings are available from SKF, FAG or other known bearing manufacturers.

One outboard end 54 and 56 of each shaft 50, 52 extends through a side wall 38 and 40, respectively. The opposite or stub end 58 and 60 of each shaft extends through the opposite side wall 38 and 40, respectively. The stub ends may be covered with end caps 62, one of which is shown. Toothed pulleys 66 and 68 are secured to the outboard ends 54, 56 of weight shafts 50 and 52.

A hydraulic gear motor 70 is located on a pressure manifold 72 secured to the upper surface of the top wall 36 of the transmission case 32. An inlet hose 74 is connected at one end to the pressure manifold 72 and extends between walls 24, 26 outwardly for connection at its opposite end to a source of hydraulic fluid under pressure (not shown). An outlet hose 76 is connected at one end to the gear motor 70 and also extends between walls 24, 26 for connection at its opposite end to a tank (not shown). A hose clamp 75 affixed to the front wall 20 secures the hoses 74 and 76. The gear motor 70 is adapted to be operatively connected to the pulleys 66 and 68 on the weight shafts 50 and 52 to rotate the weights to impart vibratory forces in only substantially linearly, e.g. in the vertical direction, as will be explained in detail hereinafter.

Below the transmission section 14, a clamping section 16 includes means for engaging and disengaging one or more piles for driving or extraction. As more particularly shown in FIG. 5, the clamping means includes a movable jaw 78 and fixed jaw 80. The movable jaw includes a cylindrical plunger 81 in a cylindrical bore 82. An inlet hose 84 and an outlet hose 86 are connected at one end to a hydraulic cylinder bore 180 and at the other ends 88, 90 to a source of hydraulic fluid and a tank, respectively (not shown). Within hydraulic cylinder bore 180 a piston 181 fits closely and is sealed to cylinder bore 180. Piston 181 is fixed to plunger 81. Hydraulic pressure in hose 86 causes piston 181 to advance and plunger 81 to clamp piles which are inserted between fixed jaw 80 and movable jaw 78. Such clamping means are conventional in vibratory pile drivers.

Typically, external gear motors consist of a pair of matched gears, one driving gear connected to an output shaft and one idler gear enclosed in one housing. Both gears in such motors have the same tooth form and are driven by fluid, e.g. hydraulic fluid, under pressure. The torque applied to the gears is a function of the pressure on one gear tooth since the pressure on other teeth is in hydraulic balance. In operation, hydraulic fluid enters the housing under pressure at a point where the gears mesh, forcing the gears to rotate in synchronization. The hydraulic fluid follows the path of least resistance around the periphery of the housing, exits at low pressure at the opposite side of the motor and is recovered in a tank. There are close tolerances between the gears and the housing and wear plates on the sides of the gears to prevent axial movement and control fluid leakage. Such conventional hydraulic gear motors are manufactured by a number of companies, for example, Commercial Intertech, Inc., Youngstown, Ohio.

Figure 8:
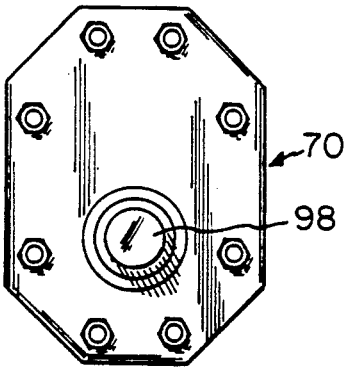
FIG. 8 is an enlarged end view of the hydraulic gear motor shown in FIG. 7.
Figure 7:
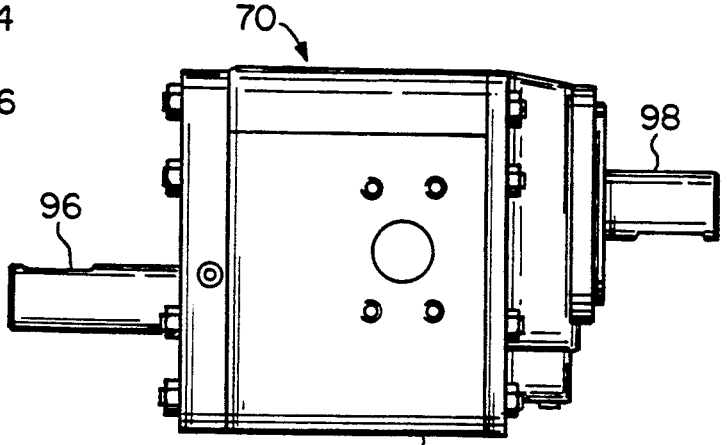
FIG. 7 is an enlarged top plan view of the hydraulic gear motor of the invention.
Figure 5:
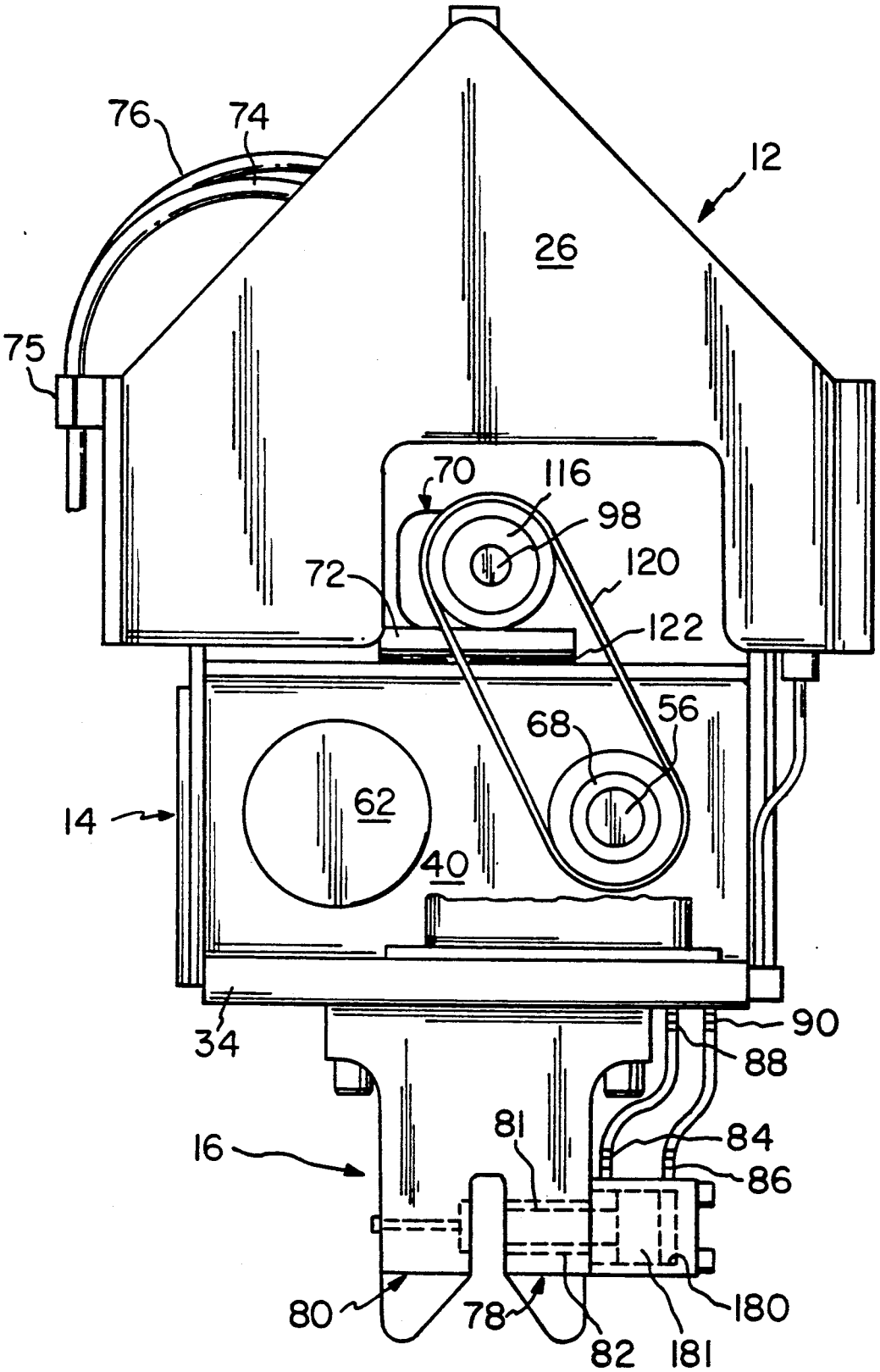
FIG. 5 is an enlarged side elevational view of one side of the vibratory pile driver of FIG. I with the suppressor section removed.
Figure 9:
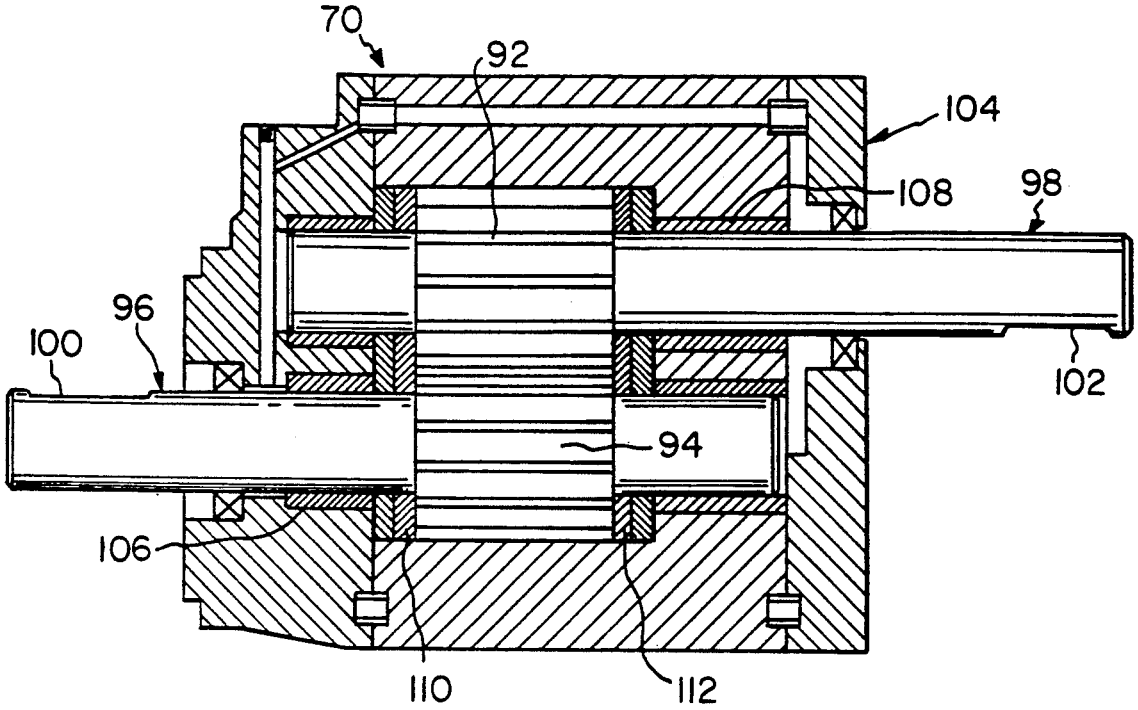
FIG. 9 is an enlarged sectional view of the hydraulic gear motor shown in FIG. 7.

In the hydraulic gear motor 70 according to the invention, as illustrated in detail in FIGS. 7, 8 and 9, each gear 92 and 94 is secured to an output shaft 96 and 98, the outboard ends 100, 102 of each shaft extending through opposite sides of housing 104. Each shaft 96, 98 is mounted in bearings 106 and 108, respectively. Wear plates 110 and 112 are provided adjacent each gear 92 and 94, respectively. The gears are driven in synchronization by hydraulic fluid entering the housing 104 via the pressure manifold 72 through inlet hose 74 and exiting through outlet hose 76. Fluid communication is provided between the manifold and the housing by an inlet opening between them, e.g. as shown in the housing 104 in FIG. 7. An outlet opening is also provided on the opposite side of the housing 104 for connection to the outlet hose 76. The gears 92 and 94 counter-rotate with respect to each other and, accordingly, drive their respective shafts 96, 98 in opposite directions.

A toothed pulley 114 and 116 is secured to the outboard end 100 and 102 of each shaft 96 and 98, respectively. The pulleys 114 and 116 are aligned in parallel vertical planes with pulleys 66 and 68 secured to the outboard ends 54 and 56 of the weight shafts 50 and 52, respectively.

A continuous toothed timing belt 118 connects pulleys 66 and 114 and an identical belt 120 connects pulleys 68 and 116 to one another. A suitable belt is manufactured by Gates Rubber Company. Synchronous counter rotation of the gears in the hydraulic gear motor, therefore, results in synchronous counter rotation of the semicircular weights in the transmission section causing vibratory forces to be imparted to a pile or similar structure engaged by the clamping means in a substantially linear direction. The tension on the belts can be adjusted by placing one or more shims 122 between the pressure manifold 72 and the top wall 36 of the transmission case 32.

Figure 12:
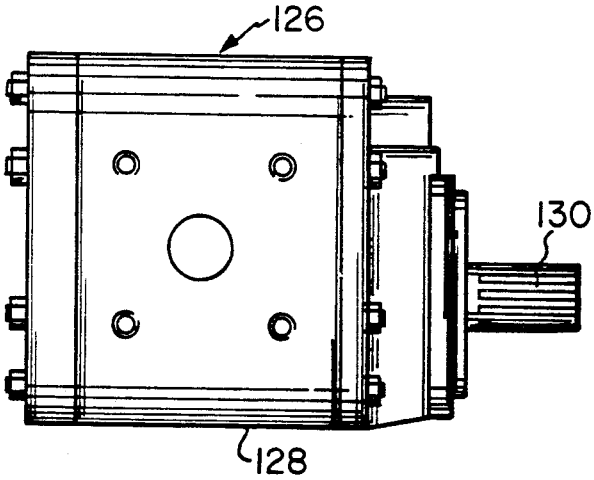
FIG. 12 is an enlarged side elevational view of a gear motor for the vibratory pile driver of FIG. 10.
Figure 13:
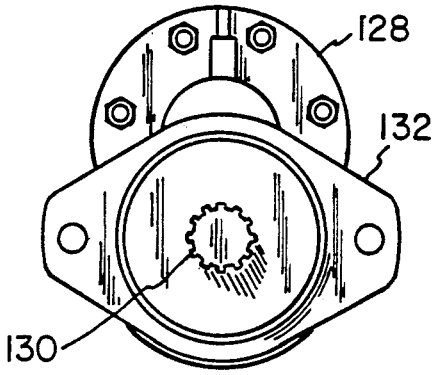
FIG. 13 is an end view of the plug-in attachment means for the hydraulic gear motor of FIG. 12.
Figure 10:
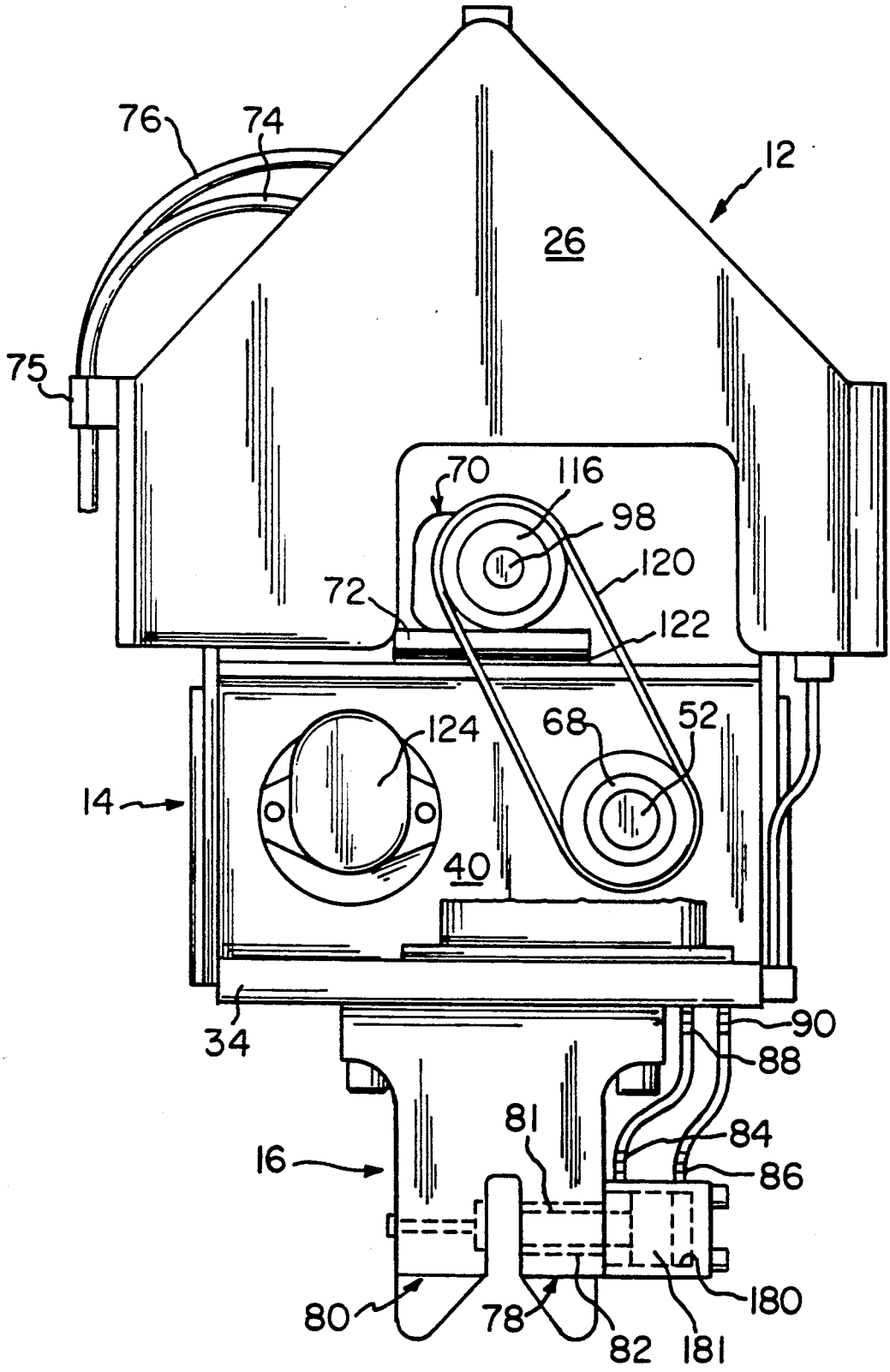
FIG. 10 is a side elevational view of a second embodiment of the vibratory pile driver including additional hydraulic gear motors plugged into the ends of the weight shafts.
Figure 11:
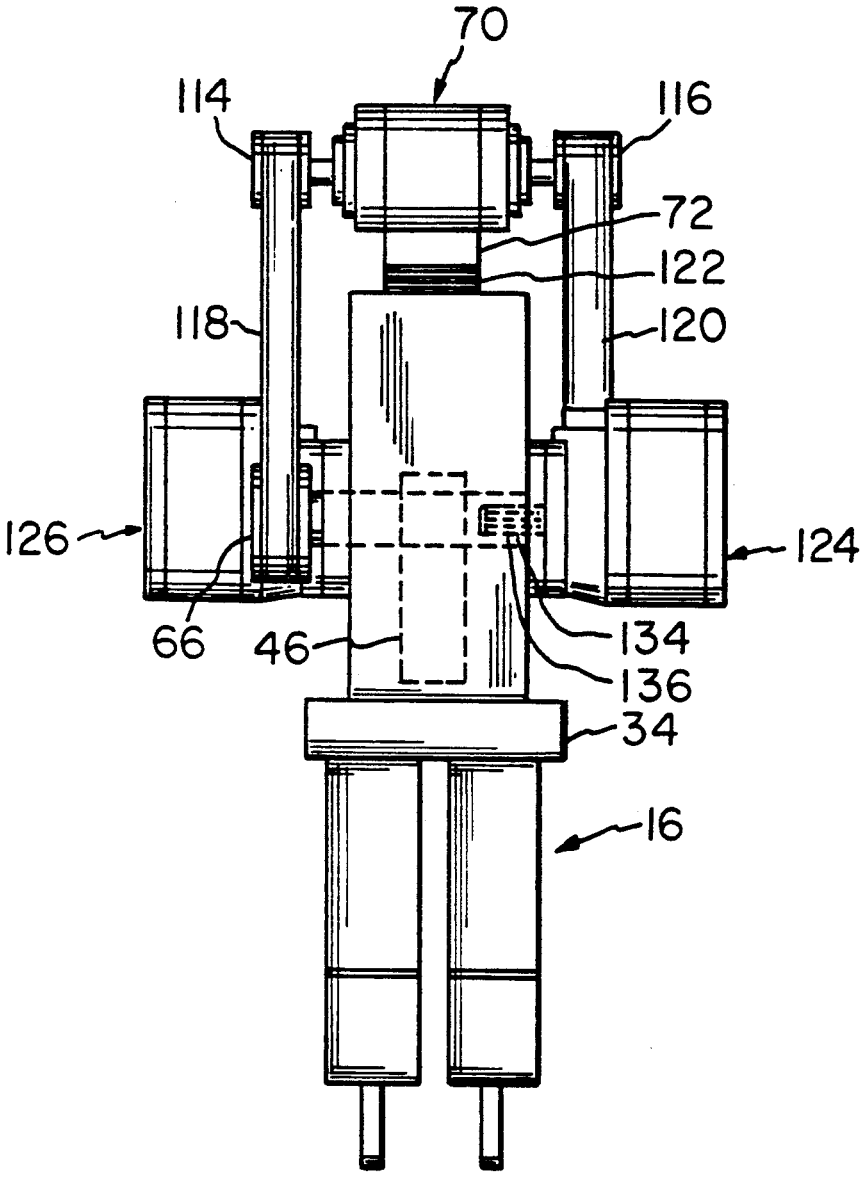
FIG. 11 is an end elevational view of the vibratory pile driver shown in FIG. 10 with the suppressor section removed.

In a second embodiment of the invention shown in FIGS. 10 and 11 wherein like elements have the same reference numerals as in FIGS. 1–9, the power transmitted to the weight shafts 50 and 52 by the hydraulic gear motor 70 can be boosted or increased substantially. This is accomplished by removing each end cap 62 which normally covers the stub ends 58 and 60, respectively, of the weight shafts 50 and 52, and plugging a conventional hydraulic motor 124 and 126 into the stub end 58 and 60 of the shafts 50 and 52, respectively. A typical motor, which may also be a hydraulic gear motor, is shown in FIGS. 12 and 13. The motor includes a housing 128 having a single shaft 130 which protrudes from the end of the housing. Attachment means, e.g. a flange 132 provided on the end of the motor, is secured to the bearing cover of side wall 38 of the transmission case 32.

The end of the shaft 130 is engaged with the weight shaft 50 via a connection comprising splines 134 on the gear motor shaft 130 and receiving female splines 136 on shaft 50 as shown in FIG. 11. When such hydraulic motors are plugged into the stub ends of both weight shafts and operated at the same speed as motor 70, three times the horsepower can be transmitted to the weight shafts, thus increasing the force transmitted through the clamping means to the pile or other structure to be driven or extracted, by increasing the size of weights which may be driven.

Significant improvements and advantages will be achieved using the invention over conventional vibratory pile drivers. In the first place, the weights in conventional vibratory pile drivers are gear driven and, therefore, the diameter of the weights presently used is restricted by the speeds at which the gears can be driven to rotate the weights to impart maximum vibratory forces on the piles or other structures to be driven or extracted. If very large gears are used and rotated at high rpm, so much dynamic force will be generated by tooth errors that the gears will be damaged unless very accurate, expensive gears are used. Since the gears in the present invention are relatively small and contained in the hydraulic gear motor, and since toothed belts are capable of very high speeds, they can be driven at substantially higher speeds, on the order of 2000 rpm, without difficulty. When additional conventional hydraulic motors are plugged into the ends of the weight shafts, even more rotational power is transmitted to the eccentric weights 46 and 48. Second, the diameter of the weights is not limited as before since the distance between weights is not governed by practical gear diameters.

The pile driver according to the present invention is relatively simple to fabricate since it uses many conventional components and is, therefore, less expensive than more sophisticated custom-designed vibratory pile drivers.

Having described presently preferred embodiments of the invention, it is to be understood that it may otherwise be embodied within the scope of the appended claims.

I claim:

1. A vibratory pile driver having means for clamping onto a pile or similar structure comprising:

a hydraulic gear motor having a case and two oppositely rotatable shafts, each shaft having an outboard end extending from the case;

a pair of semicircular weights aligned in the same plane, each weight being rotatably secured to a weight shaft in parallel to the motor shafts, each weight shaft having an outboard end;

connecting means for driving the weights from the motor shafts, said connecting means including:

drive means secured to the outboard end of each motor shaft and driven means secured to the outboard end of each weight shaft, the drive means and driven means being aligned with each other; and means for positively connecting the drive means and driven means whereby the weights are rotatably driven in synchronism by the hydraulic gear motor to provide vibratory forces in a linear direction.

2. A vibratory pile driver as set forth in claim 1 wherein said drive means comprise drive pulleys, said driven means comprise driven pulleys and said means for positively connecting the drive means and driven means comprise a toothed belt extending between each of the drive pulleys on the outboard ends of the drive shafts and each of the driven pulleys on the outboard ends of the weight shafts aligned therewith.

3. A vibratory pile driver as set forth in claim 1 or claim 2 wherein the outboard ends of each of the hydraulic gear motor shafts and of each of the weight shafts extend in opposite directions.

4. A vibratory pile driver as set forth in claim wherein each of said semicircular weights comprises an eccentric for applying vibratory forces in a linear direction through the pile driver.

5. A vibratory pile driver including a suppression section, a transmission section and a clamping section for clamping onto a pile or similar structure comprising:

a hydraulic gear motor having a case, a pair of gears engaged to one another and adapted to be rotatably driven in synchronization by hydraulic fluid, and a motor shaft affixed to each gear and having an outboard end extending in opposite directions from the case;

a pair of semicircular weights aligned in the same plane, each weight being secured to a weight shaft in parallel to the motor shafts, each weight shaft having an outboard end;

connecting means for driving the weights in synchronization from the motor shafts, said connecting means including:

drive means secured to the outboard end of each motor shaft and driven means secured to the outboard end of each weight shaft, the drive means and driven means being aligned with each other; and means for positively connecting the drive means and driven means whereby the weights are rotatably driven in synchronism by the hydraulic gear motor to provide vibratory forces in a linear direction.

6. A vibratory pile driver as set forth in claim 5 wherein said drive means comprise drive pulleys, said driven means comprise driven pulleys and said means for positively connecting the drive means and driven means comprise a toothed belt extending between each of the drive pulleys on the outboard ends of the drive shafts and each of the driven pulleys on the outboard ends of the weight shafts aligned therewith.

7. A vibratory pile driver as set forth in claim 5 wherein each of said semicircular weights comprises an eccentric for applying vibratory forces in a linear direction through the pile driver.

8. A vibratory pile driver having means for clamping onto a pile or similar structure comprising:

a hydraulic gear motor having a case and two oppositely rotatable shafts, each shaft having an outboard end extending from the case;

a pair of semicircular weights aligned in the same plane, each weight being rotatably secured to a weight shaft in parallel to the motor shafts, each weight shaft having an outboard end;

connecting means for driving the weights from the motor shafts, said connecting means including:

drive means secured to the outboard end of each motor shaft and driven means secured to the outboard end of each weight shaft, the drive means and driven means being aligned with each other;

means for positively connecting the drive means and driven means;

each of said weight shafts extending through the weight rotatably secured thereto and a further hydraulic motor having a single shaft engaged to a weight shaft to assist in driving the weight whereby the weights are rotatably driven in synchronism by the hydraulic gear motor to provide vibratory forces in a linear direction.

9. A vibratory pile driver including a suppression section, a transmission section and a clamping section for clamping onto a pile or similar structure comprising:

a hydraulic gear motor having a case, a pair of gears engaged to one another and adapted to be rotatably driven in synchronization by hydraulic fluid, and a motor shaft affixed to each gear and having an outboard end extending in opposite directions from the case;

a pair of semicircular weights aligned in the same plane, each weight being secured to a weight shaft in parallel to the motor shafts, each weight shaft having an outboard end;

connecting means for driving the weights in synchronization from the motor shafts, said connecting means including;

drive means secured to the outboard end of each motor shaft and driven means secured to the outboard end of each weight shaft, the drive means and driven means being aligned with each other;

means for positively connecting the drive means and driven means;

each of said weight shafts extending through the weight rotatably secured thereto and a further hydraulic motor having a single shaft engaged to a weight shaft to assist in driven the weight whereby the weights are rotatably driven in synchronism by the hydraulic gear motor to provide vibratory forces in a linear direction.

10. A vibratory pile driver as set forth in claim 9 wherein the shaft of the hydraulic motor includes splines, the weight shaft includes receiving splines and the splines are engaged to assist in driving the weight.

* * * * *

UNITED STATES PATENT AND TRADEMARK OFFICE

CERTIFICATE OF CORRECTION

PATENT NO. : 5,088,565

DATED : February 18, 1992

INVENTOR(S): Kingsley S. Evarts

It is certified that error appears in the above-identified patent and that said Letters Patent is hereby corrected as shown below:

Title page, under References Cited U.S. PATENT DOCUMENTS
"4,819,740 4/1989 Warrington ... 173/40" should read
--4,819,740 4/1989 Warrington ... 173/49--.

Column 2 Line 47 "I" should read --1--.

Claim 4 Line 10 Column 6 after "claim" insert --1--.

Claim 9 Line 3 Column 8 "including;" should read --including:--.

Claim 9 Line 14 Column 8 "driven" should read --driving--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*